United States Patent [19]

Sakato

[11] Patent Number: 4,776,524

[45] Date of Patent: Oct. 11, 1988

[54] CRUSHER

[75] Inventor: Seiichi Sakato, Chiba, Japan

[73] Assignee: Sakato Kousakusho Kabushiki Kaisha, Chiba, Japan

[21] Appl. No.: 75,262

[22] Filed: Jul. 16, 1987

Related U.S. Application Data

[63] Continuation of Ser. No. 817,543, Jan. 10, 1986, abandoned.

[30] Foreign Application Priority Data

Dec. 4, 1985 [JP] Japan ..... 60-187002

[51] Int. Cl.[4] ..... B02C 1/10

[52] U.S. Cl. ..... 241/101.7; 241/263

[58] Field of Search ..... 241/101.7, 201, 203, 241/263–269, 291, 300, 301; 414/739, 740; 294/104, 106, 902, 68.23; 30/134; 404/90

[56] References Cited

U.S. PATENT DOCUMENTS

| | | | |
|---|---|---|---|
| 2,828,038 | 3/1958 | Dorkins | 414/739 X |
| 3,567,050 | 3/1971 | Pasquazzi et al. | 414/740 |
| 3,772,985 | 11/1973 | Girten | 241/263 X |
| 4,196,862 | 4/1980 | Tagawa | 241/101.7 X |
| 4,406,412 | 9/1983 | Alexandersson | 241/266 X |
| 4,413,945 | 11/1983 | LaBounty | 414/739 |
| 4,512,524 | 4/1985 | Shigemizu | 241/101.7 |
| 4,558,515 | 12/1985 | LaBounty | 414/740 X |

FOREIGN PATENT DOCUMENTS

| | | | |
|---|---|---|---|
| 2340188 | 3/1974 | Fed. Rep. of Germany | 241/101.7 |
| 59-187976 | 10/1984 | Japan . | |
| 2024042 | 1/1980 | United Kingdom | 241/101.7 |

*Primary Examiner*—P. W. Echols
*Assistant Examiner*—Joseph M. Gorski
*Attorney, Agent, or Firm*—Parkhurst, Oliff & Berridge

[57] ABSTRACT

A crusher is disclosed, which comprises a stationary blade and a movable blade, the movable blade being capable of being rotated by a driver, e.g., an oil hydraulic cylinder, toward the stationary blade to clamp an object to be crushed between the stationary and movable blades and crush the object. The movable blade has tip projections projecting outwardly so that an object projecting from a road or ground surface can be clamped at its stem between the tip projections of the movable blade and the tip of the stationary blade. The object thus can be crushed from the stem. The stationary blade has a hollow frame to reduce the weight of the crusher.

2 Claims, 5 Drawing Sheets

CRUSHER

This is a continuation of application Ser. No. 817,543 now abandoned filed Jan. 10, 1986.

FIELD OF THE INVENTION

This invention relates to a crusher for dismantling reinforced concrete buildings, crushing concrete blocks, separating reinforcing iron bars therefrom and separating or crushing concrete or asphalt road pavements.

PRIOR ART

A crusher of this type has been developed by the applicant. This crusher has been filed as Japanese Patent Application No. 06273/1983.

FIGS. 10 and 12 show the crusher, which has stationary and movable blades A and B. Movable blade B can be rotated about shaft P in the directions of arrow a-b by oil hydraulic cylinder C as shown in FIG. 11. The inner surface of movable blade B has projections D as shown in FIG. 10. Stationary and movable blades A and B have respective shearing blades E and F for cutting reinforcing iron bars. This crusher is mounted on a shovel loader L as shown in FIG. 12. Object I such as concrete wall, floor, ceiling, pillar, etc. is clamped between stationary and movable blades A and B by operating cylinders M, N and O of shovel loader L and cylinder C of the crusher. The movable blade B is rotated in the direction of arrow a by operating hydraulic cylinder C for crushing object I between blades A and B. At this time, projections D help crushing object I. Reinforcing iron bars in concrete are clamped between and cut by shearing blades E and F.

PROBLEMS IN THE PRIOR ART

With the crusher shown in FIGS. 10 to 12, when movable blade B is closed as shown in FIG. 11, its tip meets a position of stationary blade A inwardly of tip H thereof. Where object I to be crushed projects from road or ground surface J as shown in FIG. 12, therefore, tip B of movable blade G will not touch road or ground surface J when movable blade B is closed with tip H of stationary blade A held in contact with surface J. Therefore, stem K of object I can not be clamped between blade tips H and G, so that it will remain without being crushed.

In addition, stationary blade A is made of a pure and heavy material, so that it is heavy and inconvenient to handle and transport as well as leading to high cost.

OBJECT OF THE INVENTION

A primary object of the invention is to provide a crusher, which can be handled in the same way as the prior art crusher and nevertheless permits crushing of object I projecting from road or ground surface J from stem K thereof.

A second object of the invention is to provide a crusher, which is light in weight and convenient to handle or transport.

SUMMARY OF THE INVENTION

The crusher according to the present invention is of an attachment type to be mounted for use on an oil hydraulic shovel loader, or the like.

The crusher according to the invention, as shown in FIGS. 1 to 9, comprises stationary blade 1 and movable blade 2 facing each other, with movable blade 2 being rotatable in the directions of arrows a-b in FIG. 2 by a driver, e.g., an oil hydraulic cylinder, to clamp object I to be crushed between stationary and movable blades 1 and 2 and crush the object.

Further, as shown in FIG. 3, the operative surface 3 of the movable blade 2 is provided with side projections *4a–4c* and central projections *5a* and *5b*. These projections are urged against the concrete block to form cracks in the concrete block which eventually break the block.

The crusher according to the invention can finely break the concrete block into fine or small pieces ranging from several cm to several tens of cm. In the case of reinforced concrete, it is possible to crush the block, separate the crushed concrete pieces and reinforcing iron bars and collect them separately.

Further, the tips 7 and 8 of the movable and stationary blades 2 and 1 may engage each other to clamp and sever the stem K of an object I projecting from the road or ground surface J or separate the concrete or asphalt on the road surface.

BRIEF DESCRIPTION OF THE DRAWINGS

FIG. 13 is a view showing a crusher according to the invention when it is in use;

FIG. 14 is an amplified side view of FIG. 9 with portions cut away to illustrate the engagement of the operative surfaces and tips and slots of the blades; and FIG. 15 is a front view of the crusher of FIG. 14 illustrating the interleaving of the tips and slots of the blades in the crushing position.

DETAILED DESCRIPTION OF THE PREFERRED EMBODIMENT

FIGS. 1 to 9 illustrate an embodiment of the crusher according to the invention.

Figure 1:
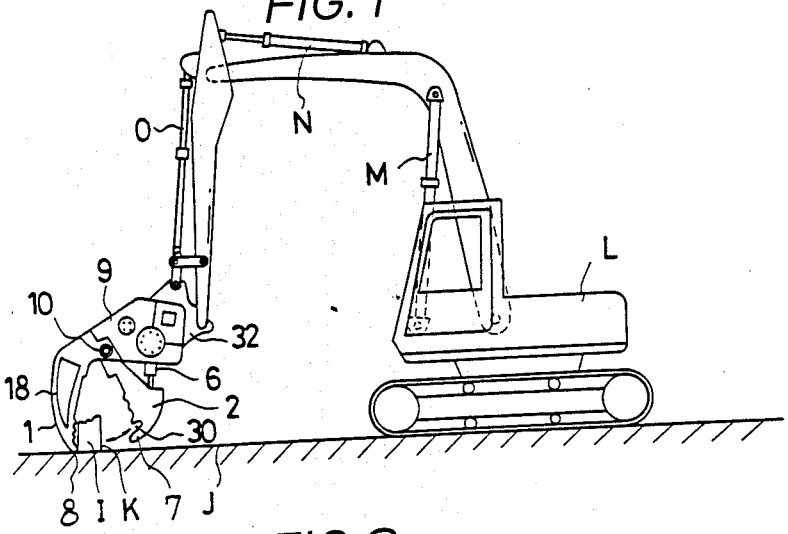
FIG. 1 is a view showing a crusher according to the invention when it is in use.
Figure 2:
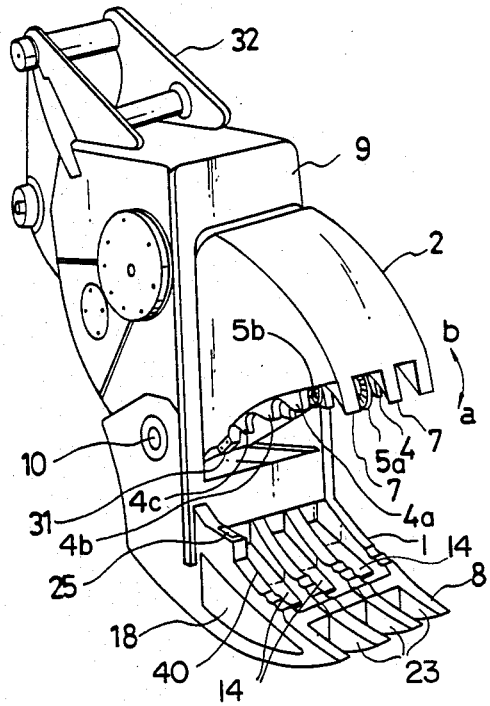
FIG. 2 is a perspective view showing the crusher according to the invention.

Referring to these Figures, there is shown a crusher which comprises stationary blade 1 and movable blade 2. Stationary blade 1 is welded to housing 9. Movable blade 2 is rotatably mounted by shaft 10 in housing 9, as shown in FIG. 2. It can be rotated in the directions of arrows in FIG. 1 by driver 6, e.g., an oil hydraulic cylinder, shown in FIG. 1.

Figure 6:
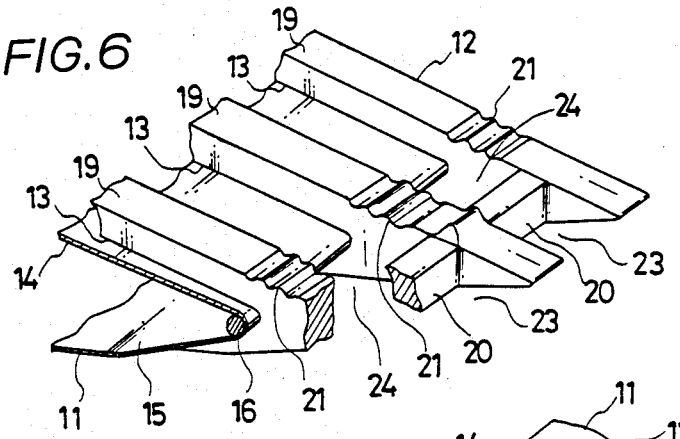
FIG. 6 is a fragmentary perspective view showing a tip portion of the stationary blade.
Figure 7:
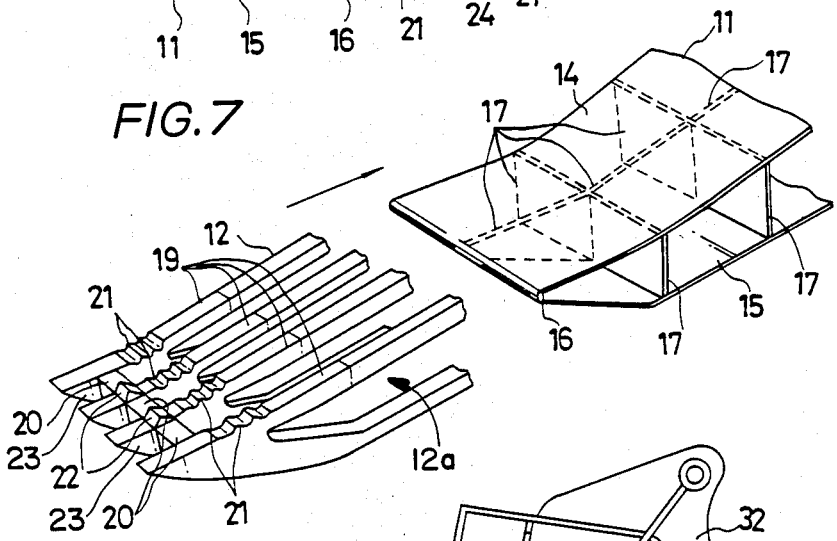
FIG. 7 is a fragmentary exploded perspective veiw showing the stationary blade before being assembled.

Stationary blade 1 has stem 12 welded as shown at 13 in FIG. 6 to support frame 11 shown in FIG. 7.

Support frame 11, as shown in FIG. 7, has upper and lower plates 14 and 15 welded to rod 16. Reinforcing members are provided between and welded to upper and lower plates 14 and 15. Support frame 11 thus is hollow. Its opposite sides are covered by side plates 8, as shown in FIG. 18, which are welded.

Stem 12 has four pawl-like member or tines 19 welded to coupling member 20. A space exists between each tine 19. These pawl-like members or tines 19 have the same shape to define upper and lower tines 19 with a receiving area 12a therebetween, i.e., a V-like shape. They have an indented top portion 21. Of the four pawl-like members 19, the intermediate two each have a projection 22, as shown in FIG. 7.

Since the stationary blade includes a hollow frame, the stationary blade is light in weight and facilitates transportation of the crusher. Moreover, since the stationary blade is light, the crusher can be driven by a low horsepower hydraulic cylinder to reduce the overall cost of the crusher.

The hollow frame of the stationary blade does not compromise the strength of the stationary blade. In particular, the reinforcing plate 17 and side plates 18 between the upper plate 14 and lower plate 15 are welded to construct a high strength hollow frame. The assembly of the stationary blade is also simplified since the frame 11 fits in a receiving area 12*a* defined between the upper and lower tines 19 of the pawl 12 and is welded such that the upper tines are secured to the upper plate 14 and the lower tines are secured to the lower plate 15. This two-piece construction of the stationary blade (i.e., the pawl 12 and frame 11) prevents gaps or openings between the tines of the pawl 12 since the upper plate 14 of the frame closes the space between the tines. Concrete blocks are crushed more finely between the movable blade 2 and the upper plate 14 of the stationary blade 1 of the present invention as compared to the stationary blade A of the device of FIGS. 10–12, since the known device includes openings Q' through which concrete fragments may drop. Thus, the device of FIGS. 10–12 cannot crush a block into fragments smaller than the openings Q' in the stationary blade A, while the inventive crusher breaks the blocks into small fragments since the upper surface of the stationary blade does not include openings between the tines. In addition, the crushing force is greater in the inventive crusher since the crushing force is not dissipated by forcing crushed material through the openings Q' in the stationary blade A of FIGS. 10–12.

Figure 10:
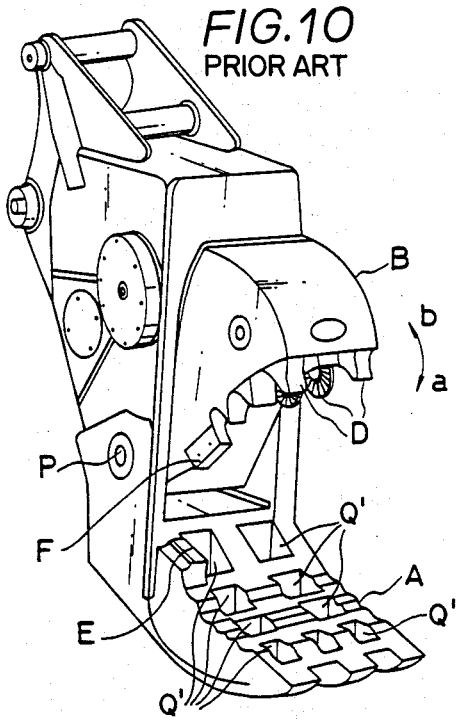
FIG.10 PRIOR ART
FIG. 10 is a perspective view showing a prior art crusher.
Figure 11:
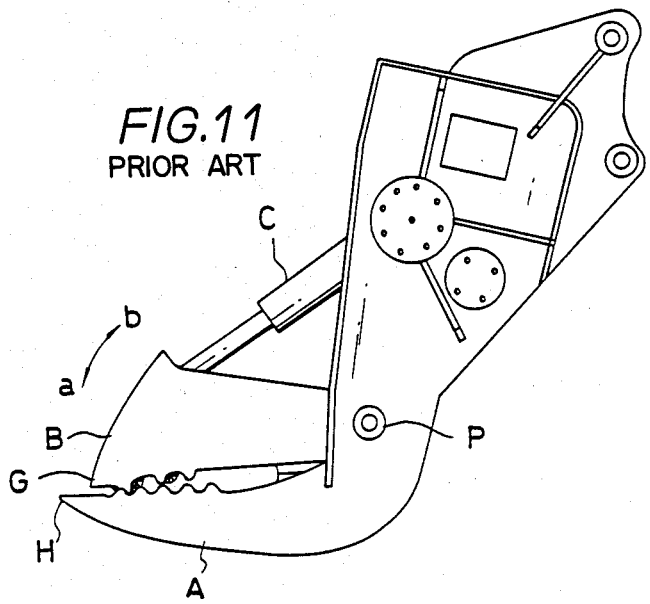
FIG.11 PRIOR ART
FIG. 11 is a side view showing the prior art crusher with a movable blade rotated into contact with a stationary blade.
Figure 12:
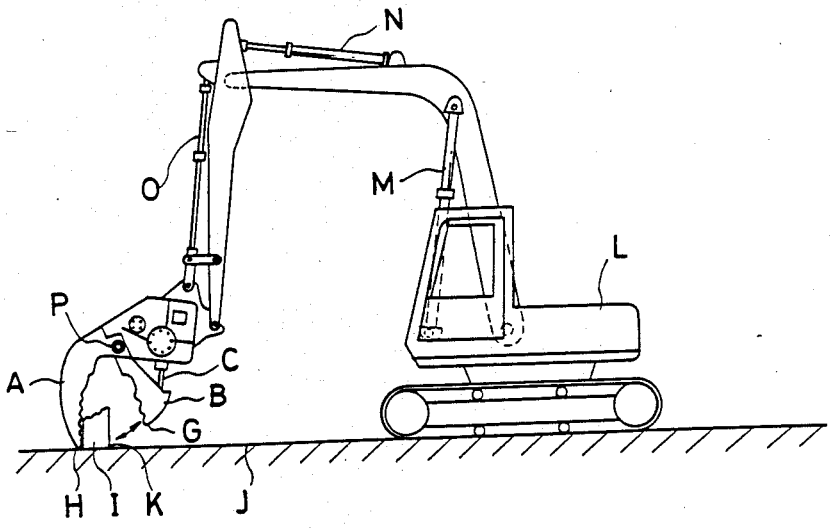
FIG.12 PRIOR ART
FIG. 12 is a view showing the prior art crusher when it is in use.

It also is noted that the crushed material of the device in FIGS. 10–12 is forced through the openings in the stationary blade which produces wear on the stationary blade and requires an additional tool to collect the dropped fragments. If the stationary blade of the device in FIGS. 10–12 becomes very worn, the entire stationary blade must be replaced. The inventive crusher obviates these disadvantages since no openings exist between the tines of the stationary blade. Accordingly, wear is reduced and an additional tool is unnecessary because the fragments can be transported by the upper plate of the stationary blade of the inventive crusher. Moreover, if the pawl 12 of the stationary blade of the inventive crusher becomes worn, only the pawl 12 need to be replaced, rather than the entire stationary blade.

Figure 5:
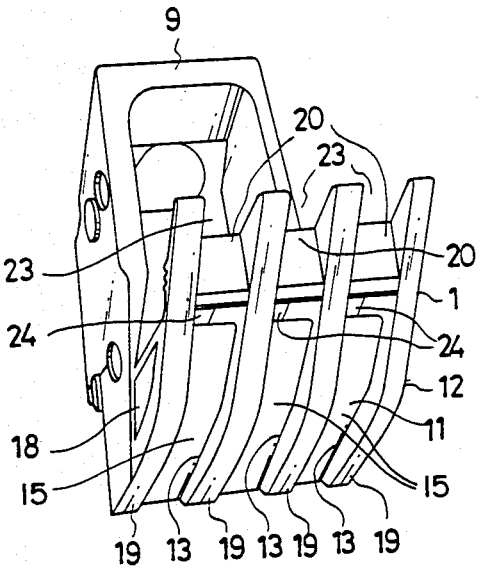
FIG. 5 is a perspective view showing a stationary blade of the crusher.

As shown in FIGS. 5 and 6, stationary blade 2 has tip spaces 23 defined between the tips of adjacent pawl-like members 19. It also has projective-receiving spaces 24.

Figure 3:
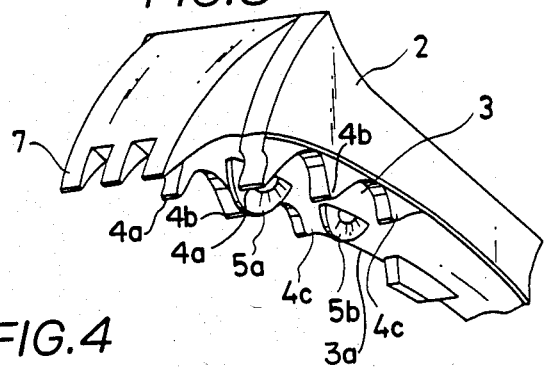
FIG. 3 is a perspective view showing a movable blade of the crusher.

In FIGS. 2 and 3, designated at 4*a*–4*c* are side projections, and at 5*a* and 5*b* are central projections.

The side projections 4*a*–4*c* are arranged in two rows extending along the opposite sides 3*a* and 3*b* of the operative surface 3 of the movable blade 2. The side projections 4*a*–4*c* have pointed ends. Also, of the side projections, the rearward ones are smaller in size.

Figure 4:
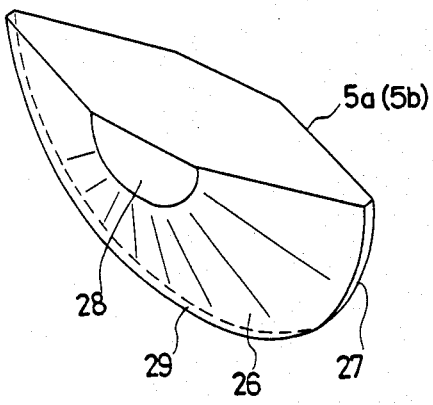
FIG. 4 is a perspective view, to an enlarged scale, showing a projection provided on the movable blade.

The central projections 5*a* and 5*b* are arranged on the operative surface 3 of the movable blade 2. These projections are provided between the two rows of side projections 4*a*–4*c*. The central projections 5*a* and 5*b* have a semi-circular disk-like structure, as shown in FIGS. 3 and 4, with the thickness becoming smaller from the central portion 28 toward the edge 29. The central projections 5*a* and 5*b* may have any other shape as well. For example, it is possible to provide central projections which each have a disk-like structure consisting of two central projections 5, shown in FIG. 4, joined together or a structure corresponding to one half the central projection 5 shown in FIG. 4.

The forward central projection 5*a* has a greater outer diameter than and projects to a greater extend toward the stationary blade 1 than the central projection 5*b*. Further, the central projection 5a projects to a greater extent toward the stationary blade 1 than the side projections 4*a*–4*c*.

The operative surface 3 of the movable blade 2 has a width sufficient to provide the side projections 4*a*–4*c* and central projections 5*a* and 5*b*. The operative surface 40 of the stationary blade 1 has a width which is somewhat greater than the width of the operative surface 3 of the movable blade 2.

Figure 8:
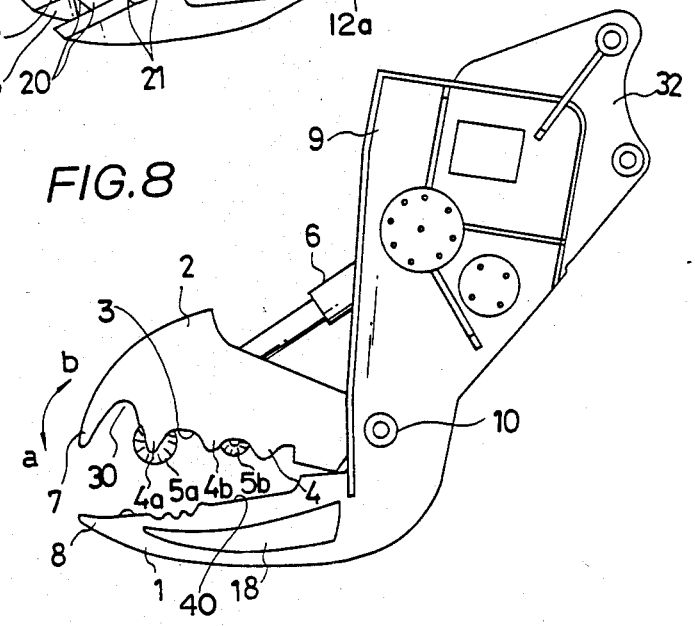
FIG. 8 is a side view showing the crusher according to the invention with the movable blade rotated toward the stationary blade.

Reference numeral 30 in FIG. 8 shows an object retaining space formed in the movable blade 2. Reference numeral 25, shown in FIG. 2, designates a shearing blade formed on the stationary blade 1, and numeral 31 represents a shearing blade formed on the movable blade 2. When the movable blade 2 is rotated toward the stationary blade 1, the outer surface of the shearing blade 31 is brought into contact with the inner surface of the shearing blade 25 of the stationary blade 1 to shear iron bars or the like. The shearing blades 25 and 31, as shown in FIG. 2, are formed on the left side of the movable and stationary blades 1 and 2, so that they can be easily seen from the operator's seat of the shovel loader L when the crusher is mounted on the oil hydraulic shovel loader as shown in FIG. 1.

MODE OF USE

The crusher according to the invention is used in the following way. The mounting member 32 of the crusher is mounted on the oil hydraulic shovel loader L, as shown in FIG. 1. In this state, the oil hydraulic cylinders M, N and O of the oil hydraulic shovel loader L are operated to vary the orientation and level of the stationary and movable blades 1 and 2 so as to clamp an object to be crushed. Next, the movable blade 2 is rotated by the driver 6 to clamp a concrete block, or the like, which may be produced when demolishing a building, between the wide operative surfaces 40 and 3 of the stationary and movable blades 1 and 2 and crush the object between the surfaces 3 and 40. In this case, since the movable blade 2 has the central projections 5*a* and 5b and the forward central projection 5a projects to a greater extent toward the stationary blade 1 than the rearward central projection 5b and side projections 4a–4c, the concrete block clamped between the operative surfaces 3 and 40 is first urged by the forward central projection 5a, whereby cracks are formed in the block. When the movable blade 2 is further rotated from this state toward the stationary blade 1, the concrete block is split at a portion where the crack is formed. When the movable blade 2 is further rotated toward the stationary blade 1, the rearward central projection 5b and side projection 4a–4c are urged against the concrete block, and the cracked blocks (i.e., coarse blocks) are further broken. When the movable blade 2 is further rotated from this state toward the stationary blade 1, the operative surface 3 of the movable blade 2 strikes the concrete block. The block is thus crushed between the operative surfaces 3 and 40 into small pieces of sizes ranging on the order of from several cm to several tens of cm.

Thus, the crusher according to the invention can crush an object stepwise (i.e., first into coarse cracked blocks and then into small pieces). Further, when an iron bar projects from the concrete block to be crushed, it is clamped and severed between the shearing blades 25 and 31 of the stationary and movable blades 1 and 2. When the movable blade 2 is closed with the stationary blade 1 in contact with the ground surface J as shown in FIG. 1, the stem K of the object I projecting upwards from the ground surface J is clamped and crushed between the tips 7 and 8 of the two blades 1 and 2.

Figure 9:
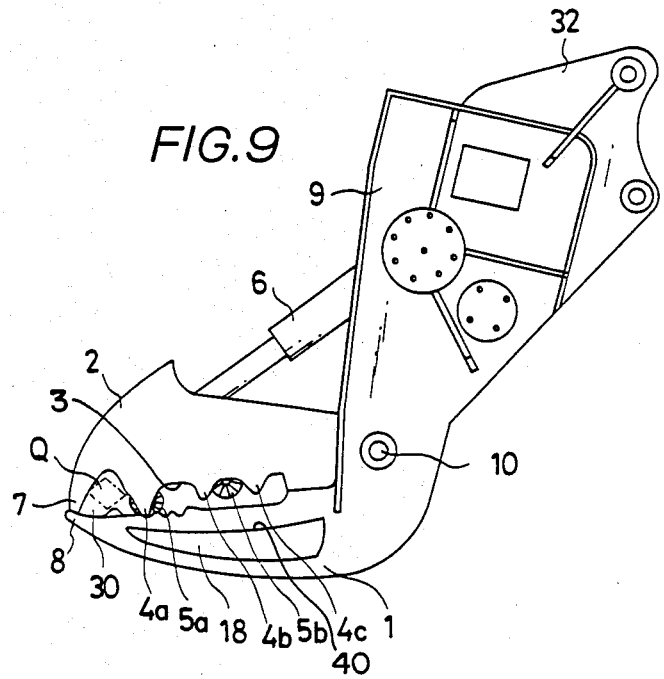
FIG. 9 is a side view showing the crusher according to the invention with the movable blade rotated into contact with the stationary blade.

It is possible to clamp an elongated block or like object Q between the stationary blade 1 and object retaining space 30 of the movable blade 2 as shown by the imaginary lines in FIG. 9.

The crusher of this invention can also separate concrete or asphalt road pavements R from the subgrade S as shown in FIG. 13. FIG. 13 shows that this crusher can separate pavement R by putting the tip 8 of the stationary blade 1 between the pavement R and the subgrade S leaving movable blade 2 open.

EFFECTIVENESS OF THE INVENTION

1. Since the operative surface 3 is provided with the side projections 4a–4c and central projections 5a and 5b, the clamped object can be readily crushed.

2. Since the thickness of the central projections 5a and 5b becomes progressively smaller from the central portion 28 toward the edge 29, the side surfaces of the central projections 5a and 5b are brought into point contact with the object when the object is urgedly crushed by the central projections 5a and 5b. Thus, the urging force of the projections 5a and 5b is concentrated at the points of contact to enhance the crushing force. Thus, the object can be reliably crushed with a weak force.

3. Since the central projections 5a and 5b and side projections 4a–4c are different in the shape and extent of projection toward the stationary blade 1, the object is crushed stepwise (i.e., first into coarse cracked blocks and then into small pieces). Thus, it is possible to crush an object smoothly and reliably even with a low horsepower shovel loader, that is, an inexpensive shovel loader can be effectively used.

4. Since the operative surfaces 40 and 3 of the stationary and movable blades 1 and 2 have a large width, it is possible to reliably clamp and crush a concrete block between the operative surfaces 3 and 40. Thus, a concrete block can be crushed into small pieces ranging in size from, for instance, several cm to several tens of cm. 5. The fact that an object can be crushed into small pieces of several cm to several tens of cm is convenient for transporting the crunched concrete block pieces on a dump truck to a different place. Further, in the case of reinforced concrete, it is possible to separate reinforcing iron bars and concrete, so that the iron bars and crushed concrete can be recovered separately. 6. Since the shearing blades 25 and 31 are provided, an objecting matter such as iron bars projecting from the concrete block can be severed by the shearing blades 25 and 31, so that it does not constitute an obstacle when the object is crushed. 7. Since the tips 7 and 8 of the movable and stationary blades 2 and 1 are adapted to engage each other, it is possible to clamp the stem K of the object I projecting upwards from the ground surface J between the tips 7 and 8 as shown in FIG. 1 to bend or sever it. Further, it is possible to separate concrete on the road surface, as shown in FIG. 13. 8. A single crusher can perform a plurality of different operations. 9. Further, since the stationary blade 1 is formed with the projection-receiving spaces 24, the movable blade 2 can be rotated sufficiently toward the stationary blade 1 without the rotation prevented by otherwise possible striking of the side projections 4a–4c and central projections 5a and 5b projecting from the movable blade 2 against the operative surface 40 of the stationary blade 1. It is thus possible to urge and crush an object into small pieces between the opposed operative surfaces 3 and 40. 10. Since the crusher is of the attachment type, it can be used in any place where the oil hydraulic shovel loader can be moved. Thus, the scope of its use can be extended.

I claim:

1. A crusher, comprising:

a stationary blade and a movable blade each having a first end and a second end, said second end of said movable blade being curved toward said second end of said stationary blade and said second end of said stationary blade being curved toward said second end of said movable blade, said stationary and movable blades being unsymetrical in shape and joined at an axis near said first ends, only said movable blade being pivotable about said axis, each of said stationary blade and said movable blade having an operative surface thereon, said operative surfaces facing each other, only said movable blade being capable of being rotated by a driver about said axis toward said stationary blade to clamp an object to be crushed between said operative surfaces of said stationary blade and said movable blade and crush the object by directing a force from the second end of the movable blade toward the operative surface of the stationary blade, said operative surface of said movable blade having a first width and said operative surface of said stationary blade having a second width greater than said first width;

side projections provided on said operative surface of said movable blade, said side projections being arranged in rows extending along opposite sides of said operative surface of said movable blade and each having a sharp end thereon;

forward and rearward central projections provided on said operative surface of said movable blade, said central projections being arranged in a row and extending in forward and rearward directions on said operative surface of said movable blade between said rows of side projections, each of said central projections having a thickness which decreases from a central portion of the central projection to an edge portion thereof;

said forward central projection having a diameter greater than the diameter of said rearward central projection, thereby projecting further towards said stationary blade than both said rearward central projection and said side projections;

a first shearing blade and a second shearing blade provided on said stationary and movable blades, respectively;

a plurality of finger like tips located at the second end of said movable blade, and a plurality of open-ended slots located at the second end of said stationary blade, a length of said movable blade being equal to a length of said stationary blade such that said slots on the stationary blade are positioned so as to receive said tips of said movable blade, said tips of said movable blade substantially engaging the slots of said stationary blade in an interleaving manner when said movable blade is rotated about said axis toward said stationary blade, thereby permitting the operative surfaces of said stationary and said movable blade to move toward contact with one another; and said stationary blade including a pawl and a hollow frame, said pawl including a plurality of upper and lower tines with a receiving area between said upper and lower tines, a space being defined between each adjacent tine of said plurality of upper tines, said hollow frame including an upper plate and a lower plate with a recess therebetween receiving reinforcing plates, said frame fitting into said receiving area of said pawl with said upper tines being secured to said upper plate and said lower tine being secured to said lower plate, said upper plate closing the spaces between the upper tines.

2. A crusher comprising:

a stationary blade and a movable blade, each having an interior end and exterior end with an operative surface therebetween, the interior ends being connected at an axis about which pivots only said movable blade to move the operative surfaces of said stationary and movable blades into contact with each other, said stationary and movable blades having equal lengths and unsymmetrical shapes with the exterior end of the movable blade being curved to extend toward the exterior end of the stationary blade to direct a force from the exterior end of the movable blade toward the operative surface of the stationary blade;

said stationary and movable blades each having a plurality of finger like tips extending from the exterior end of each of said blades with a slot defined between adjacent tips, each of said slots having an open end, a closed end, and two side walls bounded by adjacent tips, the tips of one blade being receivd in an interleaving manner with the slots of the other blade;

said stationary blade including a pawl and a hollow frame, said pawl including a plurality of upper and lower tines with a receiving area between said upper and lower tines, a space being defined between each adjacent tine of said plurality of upper tines, said hollow frame including an upper plate and a lower plate with a recess therebetween receiving reinforcing plates, said frame fitting into said receiving area of said pawl with said upper tines being secured to said upper plate and said lower tines being secured to said lower plate, said upper plate closing the spaces between the upper tines.

* * * * *